United States Patent [19]

Loucks

[11] 4,446,705

[45] May 8, 1984

[54] SHIPPING CONTAINER

[75] Inventor: Terry L. Loucks, Red Bank, N.J.

[73] Assignee: Environmental Testing & Certif. Corp., Edison, N.J.

[21] Appl. No.: 377,361

[22] Filed: May 12, 1982

[51] Int. Cl.[3] ..... F25D 3/08

[52] U.S. Cl. ..... 62/372; 62/457

[58] Field of Search ..... 62/371, 372, 457; 215/13 R

[56] References Cited

U.S. PATENT DOCUMENTS

| | | | |
|---|---|---|---|
| 1,108,017 | 8/1914 | Steel | 62/372 |
| 2,496,296 | 2/1950 | Lobl | 62/457 X |
| 2,781,643 | 2/1957 | Fairweather | 62/372 |
| 2,850,885 | 9/1958 | Mohr et al. | 62/372 |
| 2,989,856 | 6/1961 | Telkej | 62/457 X |
| 3,807,194 | 4/1974 | Bond | 62/457 |
| 3,974,658 | 8/1976 | Starrett | 62/371 X |
| 4,292,817 | 10/1981 | Loucks | 62/372 X |
| 4,344,300 | 8/1982 | Taylor | 62/457 |
| 4,344,301 | 8/1982 | Taylor | 62/457 |

*Primary Examiner*—Lloyd L. King

*Attorney, Agent, or Firm*—Fitzpatrick, Cella, Harper & Scinto

[57] ABSTRACT

A shipping container for safely maintaining contents at stabilized temperature during transit has a first insert arranged to be removably, frictionally fit between opposed side walls and formed to accommodate vials and provides storage space for packaged coolant and bottles in selected arrangement, a second insert arranged for frictional engagement with opposed side walls and formed to accommodate bottles and access formations in the side walls engaged by the first insert to permit ready removal.

9 Claims, 4 Drawing Figures

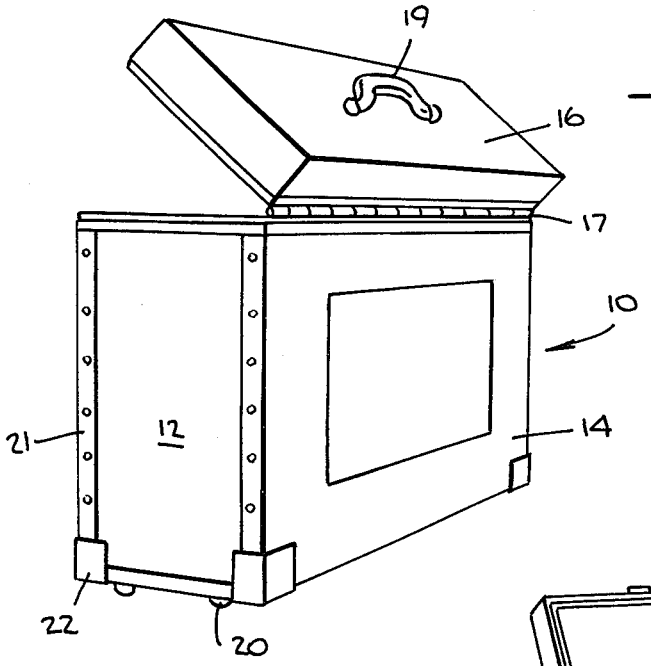
Fig. 1.
Fig. 2.
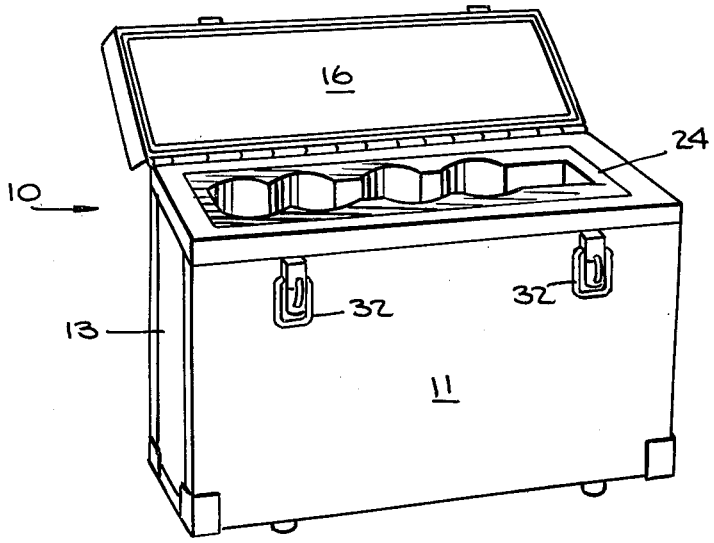
Fig. 3.
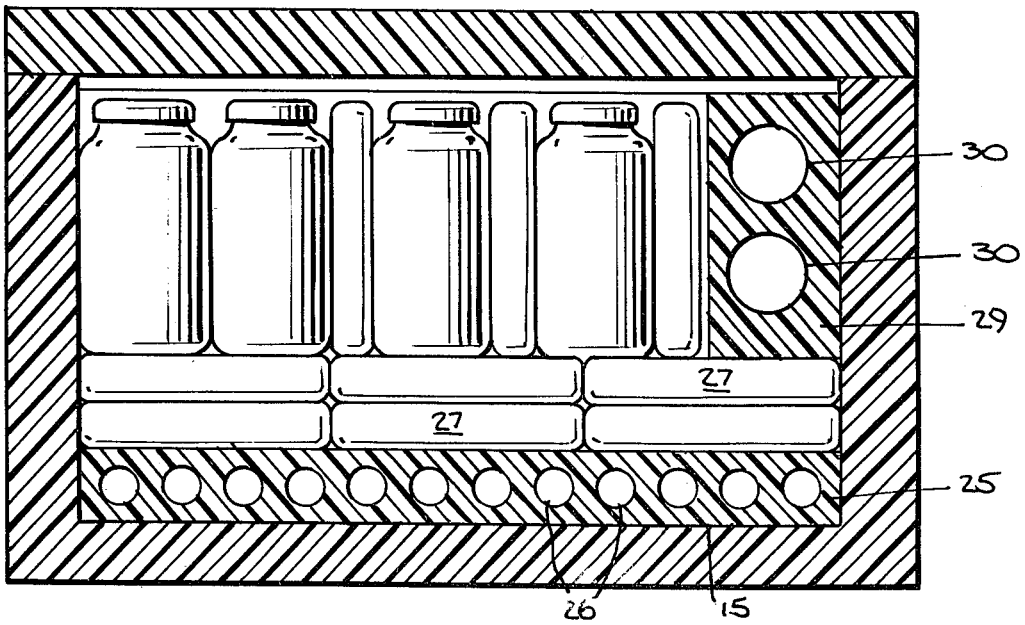

SHIPPING CONTAINER

BACKGROUND OF THE INVENTION

1. Field of the Invention

This invention relates to shipping containers, and more particularly, to temperature stabilizing, environmental containers especially adapted for the shipment of various specimens as samples which must be maintained within a predetermined temperature range for a given period of time while in transit.

2. Description of the Prior Art

A portable refrigerated container for preserving in cooled conditions various food stuffs and beverages is known from U.S. Pat. No. 2,496,296. The container there described has one or more smaller containers therein which may be positioned as desired and which constitute one or more ice-filled dividing walls, or which may serve as cooling linings for the enclosing walls of the main container. These smaller containers provide cooling surfaces for the material to be cooled and carried in the main container and which may be stored against cooling surfaces of the smaller containers, the latter also serving to cool the air in the main container. The main container is manufactured of molded plastic composition having insulating characteristics.

FIG. 2 of U.S. Pat. No. 2,496,296 illustrates several refrigerant containers supported in the main container by ribs 16 and spaced apart to allow the items to be cooled to be placed between the refrigerant containers. FIG. 8 illustrates refrigerant containers 18′ supported on tracks 34 extending along opposite sides of the interior of the main container for selective positioning therein.

A container of the general class described is also disclosed in U.S. Pat. No. 2,989,856. According to the teaching of this patent, a container is formed of corrugated board panels and has grids which comprise blocks of light weight material or the like each of which is filled with a chemical which will absorb or liberate heat for maintaining materials in transit within a given temperature range.

While the containers thus referred to may serve the particular purposes for which they are intended, there is need for a special container for the shipment of certain types of specimens which must be maintained at a temperature in the range of about 0° to 4° C. for at least 80 hours, while being able to protect the contents against physical damage. None of the containers mentioned above are suitable for these purposes.

U.S. Pat. No. 4,292,817 discloses a shipping assembly whereby wastewater samples or the like can be shipped at pre-determined temperatures, the assembly comprising a plurality of liquid retention members and temperature control means. The container includes both an outer protective layer and an inner insulating layer. The outer protective layer and the insulating layer define a shipping cavity containing the liquid retention members and the temperature control means. The liquid retention members are removably positioned in the shipping cavity such that at least one surface of each of the liquid retention members is in direct contact with at least one surface of the temperature control means. The temperature control means are said to be positioned in the shipping cavity such that the temperature of each of the liquid retention members can be controlled below predetermined levels. The disclosed assembly is somewhat limited in the amount of specimen containers it can accommodate and requires specially formed coolant containers.

SUMMARY OF THE INVENTION

I have conceived and contribute by the present invention a shipping container of the class described by which I am able safely and securely to meet the special requirements noted above without the need for special coolant containers and in a manner conveniently to transport a greater number of specimen containers than prior constructions known to me.

According to one aspect of the invention, I provide an outer container having four side walls, a bottom and a top defining an insulated storage space. I prefer that this top be pivoted to one of the four walls by a hinge extending along the full length of the upper edge of the wall. Actually, the top, bottom and walls include a lining of insulating material, the inner surfaces of which define the storage space.

An insert is adapted to be removably positioned within the storage space in friction fit with at least two opposing walls of the container and preferably with all four of the walls, the insert being formed to accommodate and retain a plurality of vials, or the like. Thus, the insert may have a plurality of bores therein for receiving and securely retaining the vials, these bores being preferably formed with their axes in a plane parallel to the plane of the bottom wall of the container.

The container is also constructed and arranged to retain packages of coolant medium for maintaining the material being shipped, such as specimens contained in the vials, below a predetermined temperature level for a given period of time.

Since certain specimens are best transported in vials while other require larger bottles, I provide a second insert adapted to be removably positioned within the storage space in friction fit with at least two opposing walls of the container and formed to accommodate and securely retain a plurality of bottles in bores formed in this second insert for that purpose, these bores preferably having their axes in planes parallel to the plane of the bores of the first insert so that the bottles lie horizontally, as do the vials, and in vertically stacked disposition when packed for shipping.

I also provide means permitting access to the portion of the first mentioned insert adjacent at least one surface of the side walls to which the insert is in frictional engagement to enable that insert readily to be removed from the storage space in spite of the frictional force by which it is held in place. Thus, I may scallop at least one side surface of the insert to provide one or more recesses between these surfaces and the facing wall of the container or insulating lining so that the insert may be removed by inserting a finger into the recesses and grasping the insert, or I may scallop the inner surface of the insulating material or lining defining the storage space, for the same purpose.

The remainder of the storage space may accommodate other bottles or the like and additional packages of coolant, as will later be described and the scalloped surfaces of the liner may also serve to support these other bottles in nesting relationship and further to allow cool air to circulate to the lower regions of the container.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description, and are shown in the accompanying drawings, forming a part of the specification wherein:

FIG. 1 is a rear perspective view of a shipping container according to the present invention with the top open;

FIG. 2 is a front perspective view of the container of FIG. 1;

FIG. 3 is a cross-sectional view of the container taken along the line 3—3 of FIG. 2 and showing the container packed for shipment.

Referring to FIGS. 1 and 2 there is shown a shipping container 10 having a front wall 11 side walls 12, 13, a rear wall 14, a bottom 15 (FIG. 3) and a top 16 which is pivotally supported from the wall 15 by a full length heavy-duty hinge 17 and is provided with a carrying handle 19. The bottom wall 14 may be equipped with short legs or wheels 20, as desired.

Figure 4:
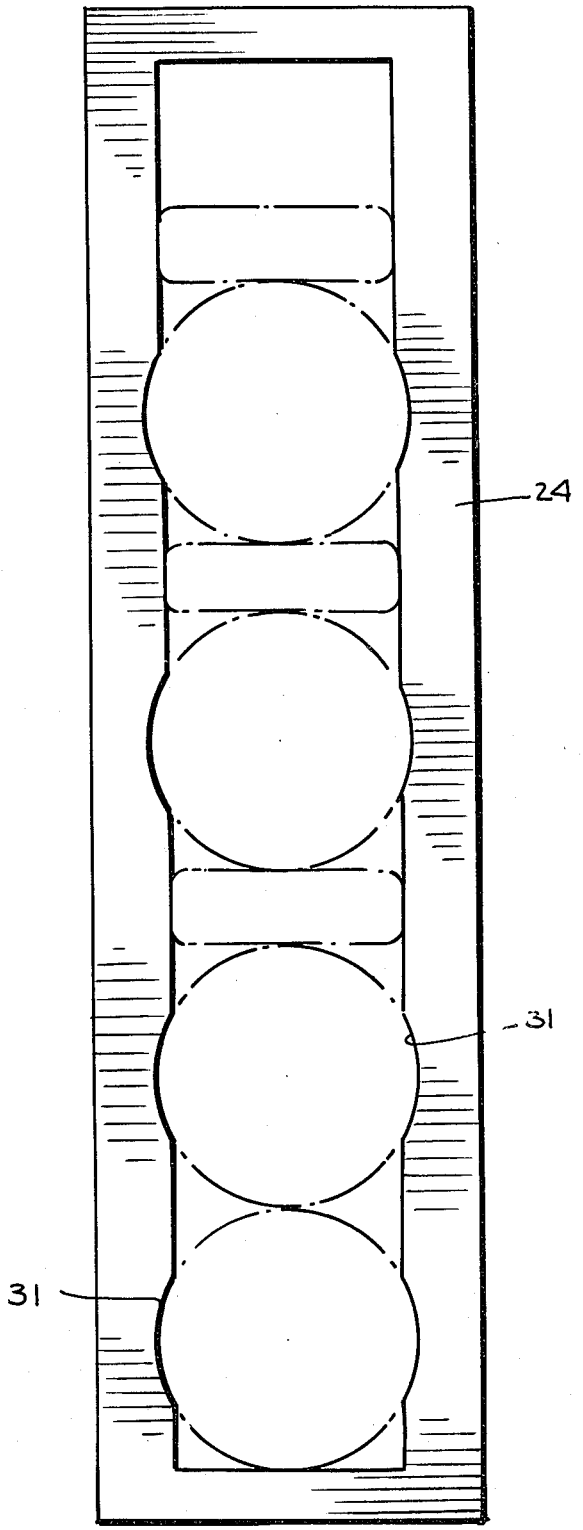
FIG. 4 is a top plan view of the liner of the empty container.

Since the container is intended to be reused, it is required that it be water-proof and able to withstand demanding field conditions. I therefore prefer to form the container 10 of hard, high density polyethelyene and to reinforce the corners as shown at 21 and 22 with metal fittings.

As shown in FIG. 2, the interior of container 10 is fitted with a permanent insulating liner 24 along each of the walls 11, 12, 13 and 14, and the top and bottom are also similarly insulated, the insulation being preferably formed of rigid polyurethane.

As best shown in FIG. 3, an insert 25 of flexible polyurethane foam is of a size and shape to be able to lie flat on the bottom of the storage space defined by the lined side walls 11, 12, 13 and 14 and in frictional engagement with the inner surfaces of the insulating liner on those walls. This insert 25 is formed with a plurality of bores 26, twelve being shown, the axes of which are in a plane parallel to the plane of the bottom surface of the layer of insulation on the bottom of the container, the bores serving to receive and retain small vessels or vials in spaced apart, parallel disposition.

The upper surface of the insert 25 serves to support a plurality of containers 27 of coolant, two layers of such containers being illustrated. These containers in turn are shown supporting a second insert 29 of flexible polyurethane foam and bored as at 30 to receive and securely retain two bottles, for example. The second insert engages two opposing walls 11 and 14 and a side wall 12 in friction fit and the remaining storage space is occupied by bottles and coolant containers, as shown, in snug disposition.

Thus, the shipping container, depicted by way of illustration, safely and securely carries twelve 40 ml vials, and a plastic 1 liter bottle (the left hand upstanding bottle as viewed in FIG. 3), for carrying specimens which need not be cooled, three 1 liter glass bottles and two 125 ml glass bottles as well as nine coolant containers, the storage space being shaped and dimensioned for the purpose. The coolant containers may be packed in two layers of three such containers lying on their sides on the insert 25, while an upstanding coolant container separates the insert 29 and one of the glass bottles as well as each of the glass bottles, the plastic bottle being disposed adjacent the left most glass bottle, as shown in FIG. 3. The upstanding coolant containers and the upstanding bottles rest on the upper layer of the horizontally disposed coolant containers.

Turning now to FIG. 4, it will be seen that the insulation lining 24 is scalloped along its vertical sides corresponding to the front and rear walls 11 and 14, these being the long walls, the scallops forming recesses 31 which may extend the full vertical length of the long walls. These recesses permit the migration of cool air to various lower parts of the storage space when the shipping container is packed and also allows one to insert one's fingers into selected recesses to grasp the sides of the insert 25 gently to remove the same from the shipping container notwithstanding the friction fit between the insert and the liner. The insert 25 may, if desired, be formed with scallops or recesses along any of its vertical walls, preferably its short walls, to facilitate removal by providing finger access. In containers using this latter design for the insert 25, the scallops along front and rear walls 11 and 14 need not extend the full vertical length of such walls.

It will be noted that the scallops in the liner 24 are disposed to mate with the surfaces of the four upstanding bottles securely to support the same in the position shown. The right hand side of the liner, where the insert 29 is shown, need not be scalloped, although it may be, since this insert can be removed by grasping its side and top surfaces after removal of the adjacent coolant container; or, since it is formed of flexible material, one hand may be inserted along the bottom of insert 29 for removal.

The vials may be used to transport volatile organic compounds, the plastic bottle for metals to be analyzed and to be shipped in acid preservatives, and the glass bottles for organic extractables (Base/Neutral and acid fractions, pesticides, herbicides, etc.), for example. The lid on top 16 has latches 32 which may be equipped with pre-coded seals to indicate unauthorized tampering.

I believe that the construction and use of my shipping container will now be understood and that the advantages thereof will be fully appreciated by those persons skilled in the art.

I claim:

1. A device of the class described comprising:

an outer container having four walls, a bottom and openable top defining an insulated storage space;

an insert of insulating material adapted to lie flat on the bottom of said storage space and to be removably positioned within the storage space in friction fit with at least two opposing of said walls and formed to accommodate and securely retain therein a plurality of vials;

said storage space being constructed and arranged to retain packaged coolant medium on the upper surface of said insert for maintaining the temperature of the content of said vials within a predetermined range for a given period of time; and means permitting access to the portion of said insert adjacent at least one of said opposing walls to which said insert is fitted to enable said insert to be removed from said storage space.

2. A device according to claim 1, wherein said insert is shaped to extend across the interior surface of the bottom of said outer container and is formed with a plurality of bores the axes of which are in a plane parallel to said interior surface.

3. A device according to claim 2, wherein said insert is shaped frictionally to engage said four walls.

4. A device according to claims 1, 2 or 3, wherein means permitting access to the portion of said insert adjacent at least one of said walls comprise a recess in one of the surfaces defining said frictional engagement whereby access to the portion of said insert adjacent one of said walls may be had to permit removal of said insert from said storage space.

5. A device according to claims 1, 2 or 3, wherein the interior surface of at least one of said walls of said outer container is scalloped to permit access between that wall and said insert to enable removal of said insert from said storage space.

6. A device according to claims 1, 2 or 3 wherein at least one surface of said insert adapted for frictional engagement with a wall of said containers is scalloped to permit access therebetween to enable removal of said insert from said storage space.

7. A device of the class described comprising:

an outer container having four walls, a bottom and an openable top defining an insulated storage space;

a first insert adapted to be removably positioned within the storage space in friction fit with at least two opposing of said walls and formed to accommodate and securely retain a plurality of vials;

a second insert adapted to be removably positioned within the storage space in friction fit with at least two opposing of said walls and formed to accommodate and securely retain a plurality of bottles;

said storage space being constructed and arranged to retain packaged coolant medium for maintaining the temperature of the content of said vials and bottles within a predetermined range for a given time period; and means permitting access to the portion of said first and second inserts adjacent at least one of said opposing walls, to which said inserts are respectively fitted, to enable said inserts to be removed from said storage space.

8. A device of the class described comprising:

an outer container having four walls, a bottom and a top hingedly connected to one of said walls, said walls bottom and top being lined with insulating material defining a storage space;

a first insert adapted to be removably positioned within the storage space to lie against the bottom thereof and in friction fit with the inner surface of the insulating material lining said four walls, said first insert being bored to receive and retain a plurality of vials, the axes of the bores being in a plane parallel to said bottom wall;

a second insert adapted to be removably positioned within the storage space in friction fit with the insulating material lining at least two of said walls facing one another and bored to receive and retain a plurality of bottles;

said storage space being constructed and arranged to retain packaged coolant medium between said inserts, and to accommodate additional bottles and packaged coolant medium, to maintain the temperature of the content of the vials and bottles below a predetermined level for a given time period;

the interface between the insulating material lining at least two opposed of said walls and adjacent surfaces of said inserts being formed to define recesses therebetween to enable removal of said inserts from said storage space.

9. A device of the class described comprising:

an outer container having four walls, a bottom and openable top defining an insulated storage space; and an insert of insulating material adapted to lie flat on the bottom of said storage space and to be removably positioned within the storage space in friction fit with at least two opposing of said walls and formed to accommodate and securely retain therein a plurality of vials;

said storage space being constructed and arranged to retain packaged coolant medium on the upper surface of said insert for maintaining the temperature of the content of said vials within a predetermined range for a given period of time.

* * * * *